US012539949B2

(12) United States Patent
Ko

(10) Patent No.: US 12,539,949 B2
(45) Date of Patent: Feb. 3, 2026

(54) FREE DIVING WEIGHT BELTS WITH ACCESSORY ATTACHMENTS

(71) Applicant: Phillip Ko, San Francisco, CA (US)

(72) Inventor: Phillip Ko, San Francisco, CA (US)

( * ) Notice: Subject to any disclaimer, the term of this patent is extended or adjusted under 35 U.S.C. 154(b) by 146 days.

(21) Appl. No.: 18/389,452

(22) Filed: Nov. 14, 2023

(65) Prior Publication Data

US 2025/0153820 A1 May 15, 2025

(51) Int. Cl.
*B63C 11/30* (2006.01)

(52) U.S. Cl.
CPC ..... *B63C 11/30* (2013.01); *B63C 2011/306* (2013.01)

(58) Field of Classification Search
CPC ..... B63C 11/52; B63C 11/30; B63C 11/306; B63C 2011/026; A41F 9/00; A41F 9/02; A41D 13/0012; A41D 27/08; A41D 2200/10
USPC ..... 405/186; 2/311, 312, 338
See application file for complete search history.

(56) References Cited

U.S. PATENT DOCUMENTS 3,648,324 A * 3/1972 Stradella ..... B63C 11/30 16/404
3,735,598 A * 5/1973 Oeland, Jr. ..... B63C 11/30 405/186
3,848,271 A * 11/1974 Goele ..... A41F 9/002 2/338
4,732,305 A 3/1988 Courtney et al.
5,501,379 A * 3/1996 Munoz ..... B25H 3/00 224/684
5,749,127 A 5/1998 Hsieh
7,367,749 B2 * 5/2008 Kim ..... A45F 3/047 405/186
12,295,439 B2 * 5/2025 Roberson ..... A41F 9/00
2005/0098597 A1 * 5/2005 Cottrell ..... B63C 11/30 224/629
2009/0317193 A1 12/2009 Wang
2023/0074753 A1 * 3/2023 Roberson ..... A41F 9/00

FOREIGN PATENT DOCUMENTS

FR 1314255 A 1/1963
KR 102547384 B1 6/2023
WO WO-2019021327 A1 * 1/2019 ..... A44B 11/006

OTHER PUBLICATIONS

PCT Int'l. Search Report, Apr. 30, 2025, pp. 1-5.
PCT Written Opinion, Apr. 30, 2025, pp. 6-17.

* cited by examiner

*Primary Examiner* — Frederick L Lagman
(74) *Attorney, Agent, or Firm* — Robert Moll

(57) ABSTRACT

The invention relates to a free diving weight belt including a belt with a buckle that supports attaching a variety of accessories and/or a knob-back screw fastener that can be used to reconfiguring the belt. It permits attaching a variety of screw-on attachments, including but not limited to clips, knives, snorkels, weights, D-rings, weight keepers, and knife holders. It also provides the knob-back screw fasteners to secure excess belt extending beyond the buckle and/or hassle-free attachment of accessories.

13 Claims, 10 Drawing Sheets

FREE DIVING WEIGHT BELTS WITH ACCESSORY ATTACHMENTS

BACKGROUND

The present invention relates to weight belts useful for free divers, and in particular weight belts that can be quickly removed and that can detachably hold a variety of accessories for the diver's use.

Free diving also referred to as freediving or skin diving is a form of underwater diving that relies on the diver holding his or her breathe until surfacing rather than use of scuba gear.

Free divers typically snorkel, explore the ocean, spearfish, take photographs, videos, and even engage in a free diving competition. Beside the challenge of holding one's breath to do all that, the diver's buoyancy (e.g., air in lungs, body, wetsuit) will make it difficult to descend at depth (e.g., beyond 20 feet), and the greater the depth the more buoyancy thwarts the diver's ability to maintain a given depth much less descend further. As divers descend, the increased pressure compresses the air spaces, reducing buoyancy. Conversely, as they ascend and pressure decreases, these air spaces expand, increasing buoyancy. Weight belts are essential in helping divers to overcome their initial buoyancy to submerge and to maintain neutral buoyancy at depth, ensuring a safe and enjoyable diving experience.

A free diver may wear a weight belt to counteract this buoyancy. Because buoyancy varies among divers, the weight belts allow one or more weights to be attached. At the same time if the diver must surface quickly, e.g., diver is out of breath where the weight of belt is an issue, the weight belt must be reliably jettisoned in a single motion of a diver's hand. It can save one's life to sacrifice the weight belt to the bottom of the ocean, or in some cases it can be retrieved later with a subsequent dive with or without scuba gear, but to be weighted down when a diver needs to come up quickly is not good. Anything more than a quick unbuckle, such as untying a knotted belt or pulling a band off the belt, which require both hands can be dangerous if the free diver lacks experience or composure to remove the weight belt quickly.

Separately, weight belts are used to attach various accessories (e.g., d-rings, fish stringers, flashlights, belt reels, snorkels, spears, knives, and cameras) the diver wants to use during the dive. The diver cannot readily modify the weights and accessories for a particular activity much less modify the location of the accessories and the weights, because they must come off the belt, which wastes time and cannot be safely done while the diver is in the water.

SUMMARY OF THE INVENTION

The present invention relates to a free diving weight belt including a belt with a buckle that supports attaching a variety of accessories and/or a knob-back screw fastener that can used to reconfigure the belt.

The invention supports attaching a variety of screw-on attachments, including but not limited to clips, knives, snorkels, weights, D-rings, weight keepers, flashlights, fish stringers and knife holders.

In a feature, the knob-back screw fasteners secure excess belt extending beyond the buckle and/or hassle-free attachment of accessories.

In another feature, the knob-back screw fasteners can be secured to the belt by punching a small hole anywhere on the belt. This allows users to secure excess belt material and can attach or detach various accessories.

In still another feature, the invention avoids the need to slide accessories and weights off the belt itself to change the accessories. This makes it convenient for divers to tailor their gear to specific needs without wasting time removing various accessories and weights on the belt.

Instead, the invention permits adding accessories to a belt by punching a small hole in a belt, and using a back screw to rotational engage with a threaded post on the accessories such as a ring, belt management knobs, snorkel holder, or knife holder. Thus, a diver can customize the belt quickly even during a dive, which means more time diving and safety, and less time fiddling with setup.

DETAILED DESCRIPTION OF THE PREFERRED EMBODIMENTS

The following description includes the best mode of carrying out the invention. The detailed description illustrates the principles of the invention and should not be taken in a limiting sense. The scope of the invention is determined by the claims. Each part is assigned a unique number throughout the specification and the drawings.

Figure 1:
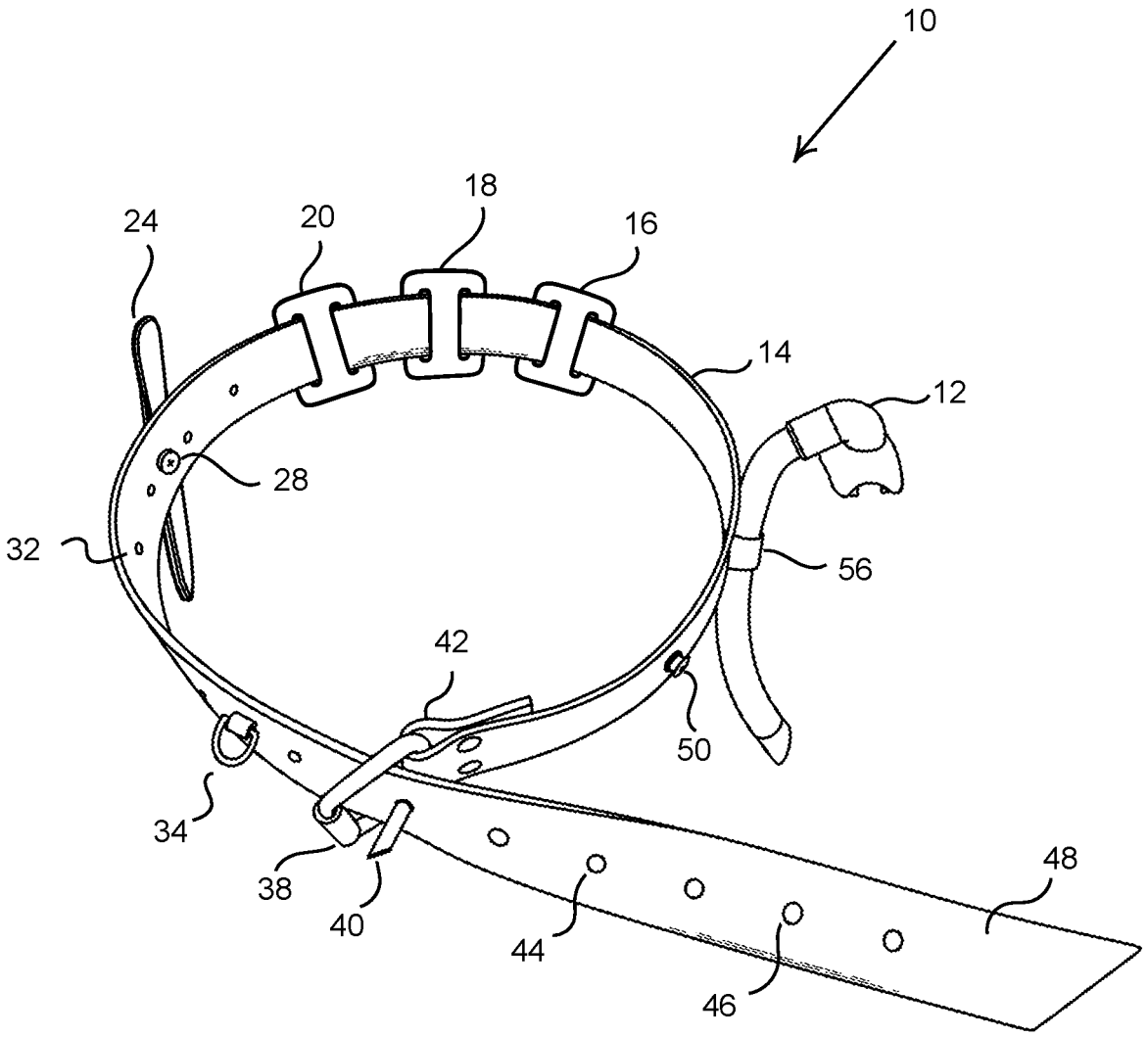
FIG. 1 is a perspective view of an embodiment of a free diving weight belt of the present invention.

FIG. 1 is a perspective view of an embodiment of a free diving weight belt 10, including a belt 14 with screwed on accessories, e.g., a snorkel 12, a knife 24, and a ring 34. One or more weights (e.g., weights 16, 18, and 20) are secured on the belt 14 to overcome diver buoyancy.

The belt 14 is preferably an elastic, durable, water resistant material (e.g., rubber or silicone) that can maintain the size of punch holes, that is, won't tear in use.

FIG. 1 also shows a back screw fastener 28 in a hole of the belt 14 to secure the knife 24. The belt 14 also shows holes (e.g., a hole 32) for locating the knife 24 closer to the front of the belt 14 or to attach another accessory (not shown).

FIG. 1 also shows a snorkel has a holder 56 that is secured to the belt 14 as will be explained below.

The belt 14 has a loop 42 to secure a belt buckle 38, 40 in a belt hole (belt holes 44 and 46 are for larger waist sizes). For safety reasons, the diver can remove the free diving weight belt 10 by pulling the excess end 48 of the belt 14 in a sweeping outward motion.

Figure 2:
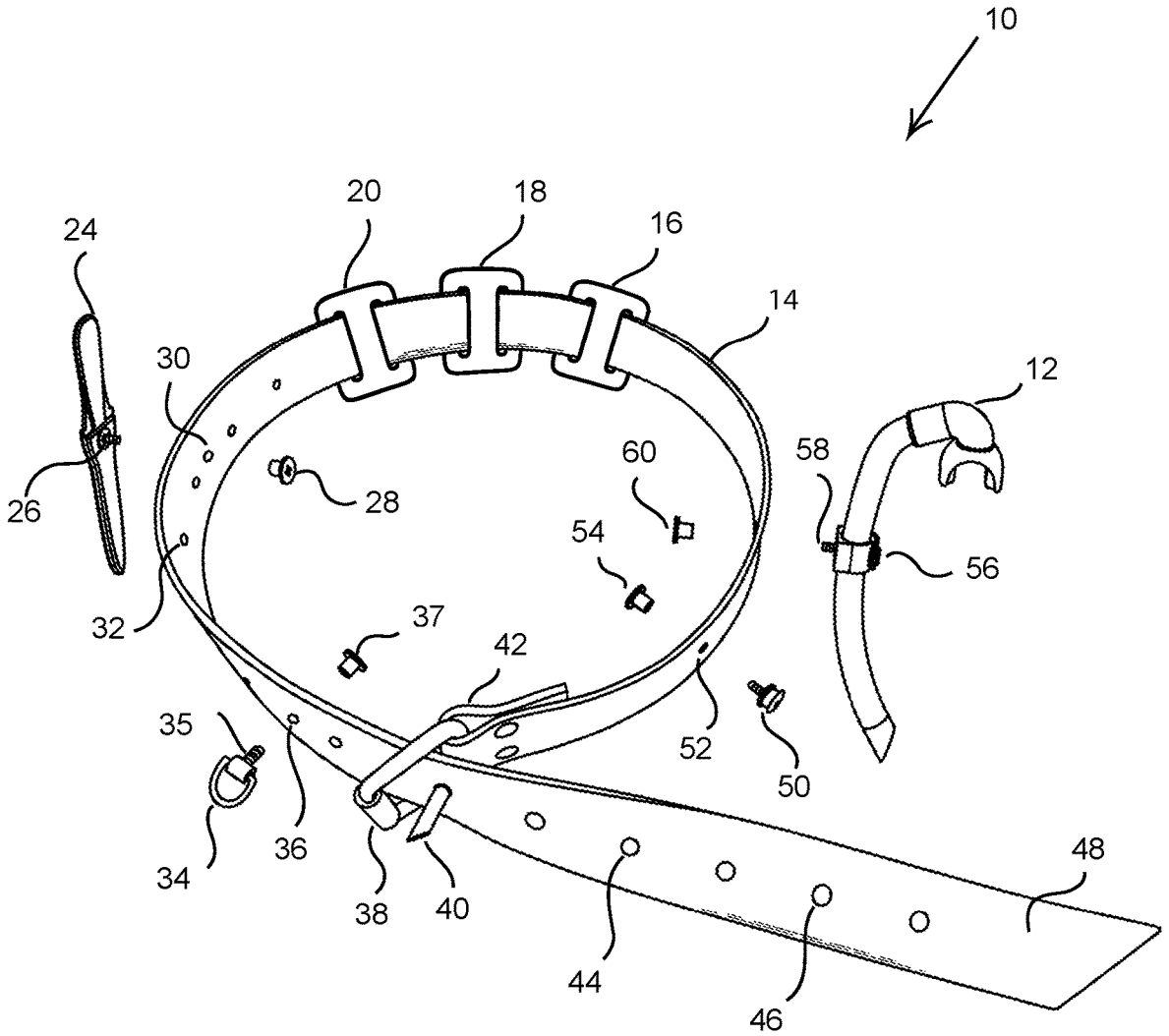
FIG. 2 illustrates the free diving weight belt shown in FIG. 1 with the knob-back screw fasteners and accessories removed from the belt.

FIG. 2 illustrates the free diving weight belt 10 as shown in FIG. 1, plus shows back screw fasteners and accessories removed from the belt 10. Specifically, a threaded post 58 extending from holder 56 for snorkel 12 rotationally secures the holder 56 in a back screw 60. A threaded post 26 integral or attached to the knife 24 rotationally secures the knife 24 in a back screw 28 in a hole 30. A threaded post 35 integral or attached to the ring 34 rotationally secures the ring 34 in a back screw 37. In these embodiments, rotation in one direction (e.g., clockwise) secures the accessory on belt 14 and rotation in the opposite direction (e.g., counterclockwise) detaches the accessory. In another embodiment, a back screw 54 and a knob 50 are rotationally secured in hole 52 to secure the excess end 48 of the belt 14. See FIGS. 1 and 4 and accompanying specification for further details.

Figure 3A:
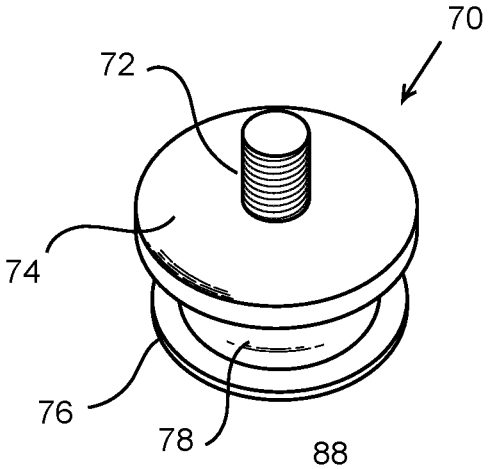
FIG. 3A illustrates a perspective view of an embodiment of the knob-back screw fasteners, where the knob is shown apart from the back screw.

FIG. 3A illustrates a perspective view of an embodiment of a knob-screw back fastener 70, 80 that will be rotationally secured in a hole of the belt 14 (FIGS. 1-2). When secured the knob 70 is visible on the outside of the belt 14 (See FIGS. 1-2) when worn by the diver (not shown) and the back screw 80 is on the inside of the belt 14.

The knob 70 is a spool shaped cylinder with a bottom rim 74 and a top rim 76 that have larger diameters than the cylinder 78 in between the rims 74, 76 as shown in FIG. 3A. When the fastener is secured to the belt 14, the bottom rim 74 of knob 70 is adjacent the belt 14 and has a threaded post 72 extends through a hole in belt 14 and engages the threads 84 inside the cylinder 82 extending from the washer 86 of the back screw 80 extending into the hole in the belt 14.

Figure 3B:
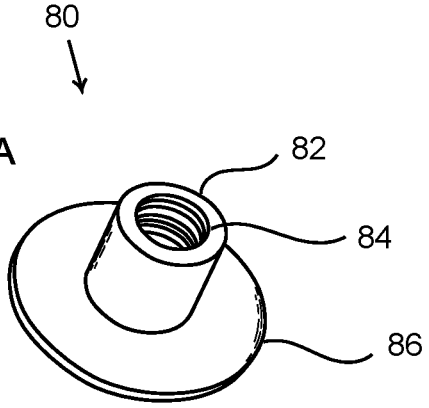
FIG. 3B illustrates a perspective view of an alternative embodiment of the knob-back screw fasteners with the knob shown apart from back screw.
Figure 3B:
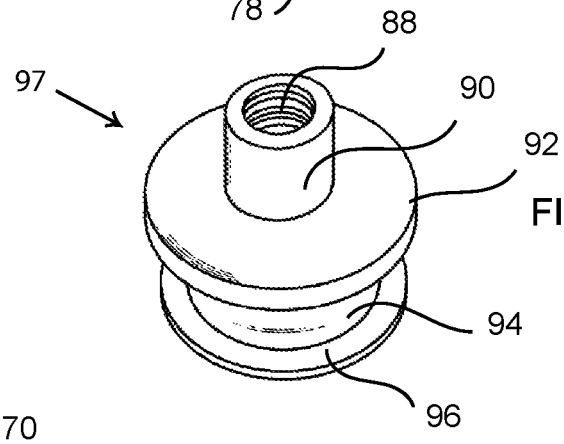

FIG. 3B illustrates a perspective view of an alternative embodiment of a knob-back screw fastener 97, 98 that will be rotationally secured in a hole of the belt 14 (not shown). When secured the knob 97 is visible outside of the belt 14 and the back screw 98 is visible inside the belt 14.

As shown, the knob 97 is spool shaped cylinder with a bottom rim 92 and a top rim 96 that have larger diameters than the cylindrical portion 94 in between as shown in FIG. 3B. In this alternative embodiment, the back screw 98 includes a post 104 with threads 102 that extends from a washer 100 and the knob 97 has a cylinder 90 with internal threads 88 that engage the threads 102.

When the knob-back screw fastener is secured to the belt 14 (not shown), the bottom rim 92 of the knob 97 is outside the belt 14. Further, the threads 102 of the post 104 that extend from the washer 100 engage the threads 88 of the knob 98.

In the knob-back screw fasteners shown in FIGS. 3A-3B, rotation in one direction (e.g., clockwise) secures the knob 70 and 97 to respective back screws 80 and 98 on the belt 14 and rotation in the opposite direction (e.g., counterclockwise) detaches the knob-back screw fasteners.

Figure 3C:
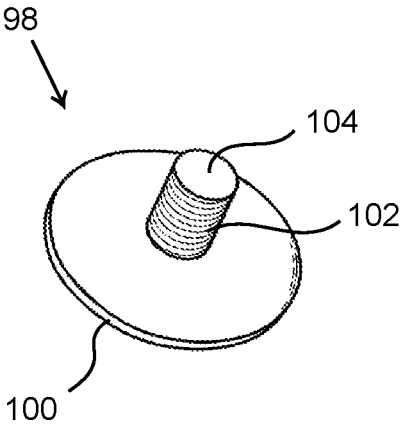
FIG. 3C illustrates a perspective view of an embodiment of the assembled knob-back screw fastener.
Figure 3C:
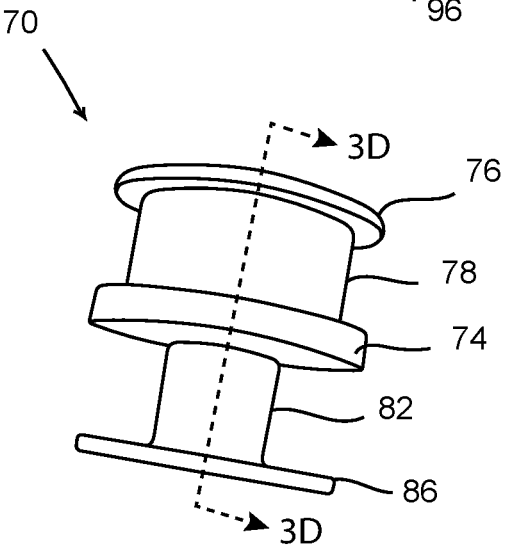
Figure 3D:
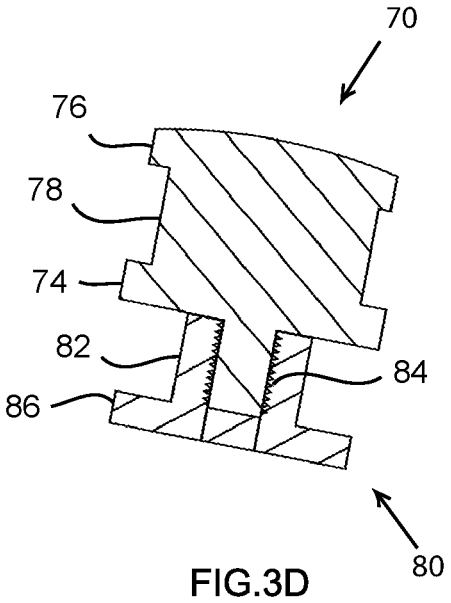
FIG. 3D illustrates a cross-sectional view of the knob-back screw fastener shown in FIG. 3C.

FIG. 3C-3D illustrate a perspective view of an embodiment of the assembled knob-back screw fastener 70. FIG. 3D illustrates a cross-sectional view of the knob-back screw fastener 70 shown in FIG. 3C. The parts shown in FIG. 3A are shown in FIGS. 3C and 3D so retain the same part numbers. For brevity, the parts will not be described again in connection with FIGS. 3C and 3D.

Figure 4:
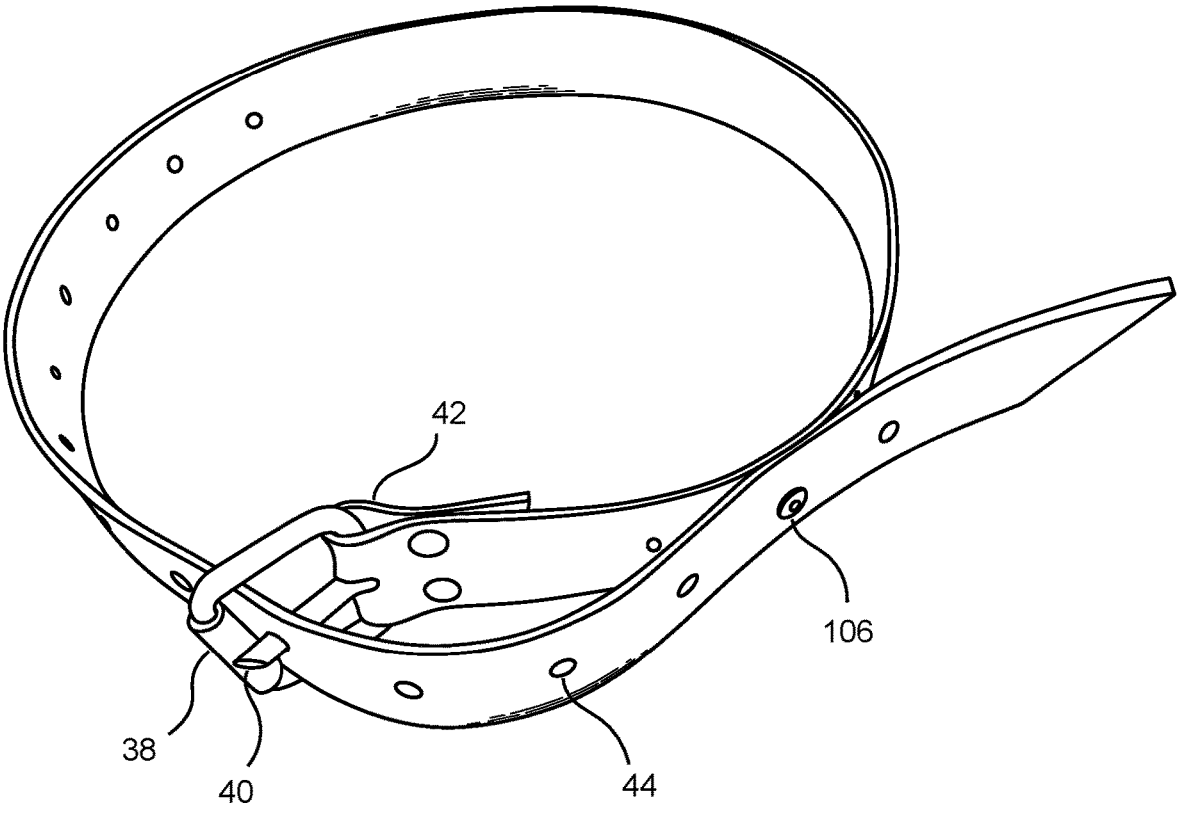
FIG. 4 illustrates another embodiment of a free diving weight belt with a knob-back screw fastener securing the excess end of the belt in a safe manner.

FIG. 4 illustrates another embodiment of the belt 14 using a knob-back screw fastener 106 (like one of the fasteners shown in FIGS. 3A-3D) to secure the excess end of the belt 14 and permit a single handed sweep motion to pull the belt off the belt buckle 38, 40, and 42 in a safe manner. Belt hole 44 is not used.

Figure 5:
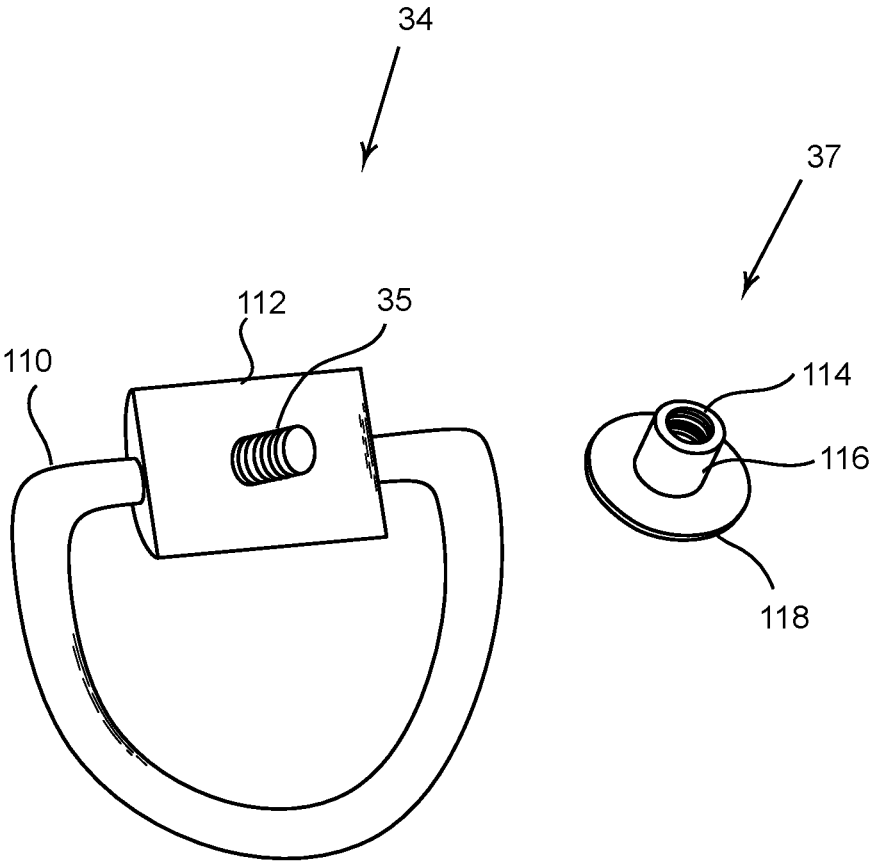
FIG. 5 illustrates an embodiment of a ring with a back screw fastener.

FIG. 5 illustrates an embodiment of a ring 34 with a back screw fastener. In an embodiment, the ring 34 includes a loop 110 integral or attached to a support member 112. A threaded post 35 extends from the member 112. A back screw 37 includes a cylinder 116 with internal threads 114 extending from a washer 118, which will be secured to the belt 14 as described earlier (See FIGS. 1-2 and the accompanying specification).

Figure 6:
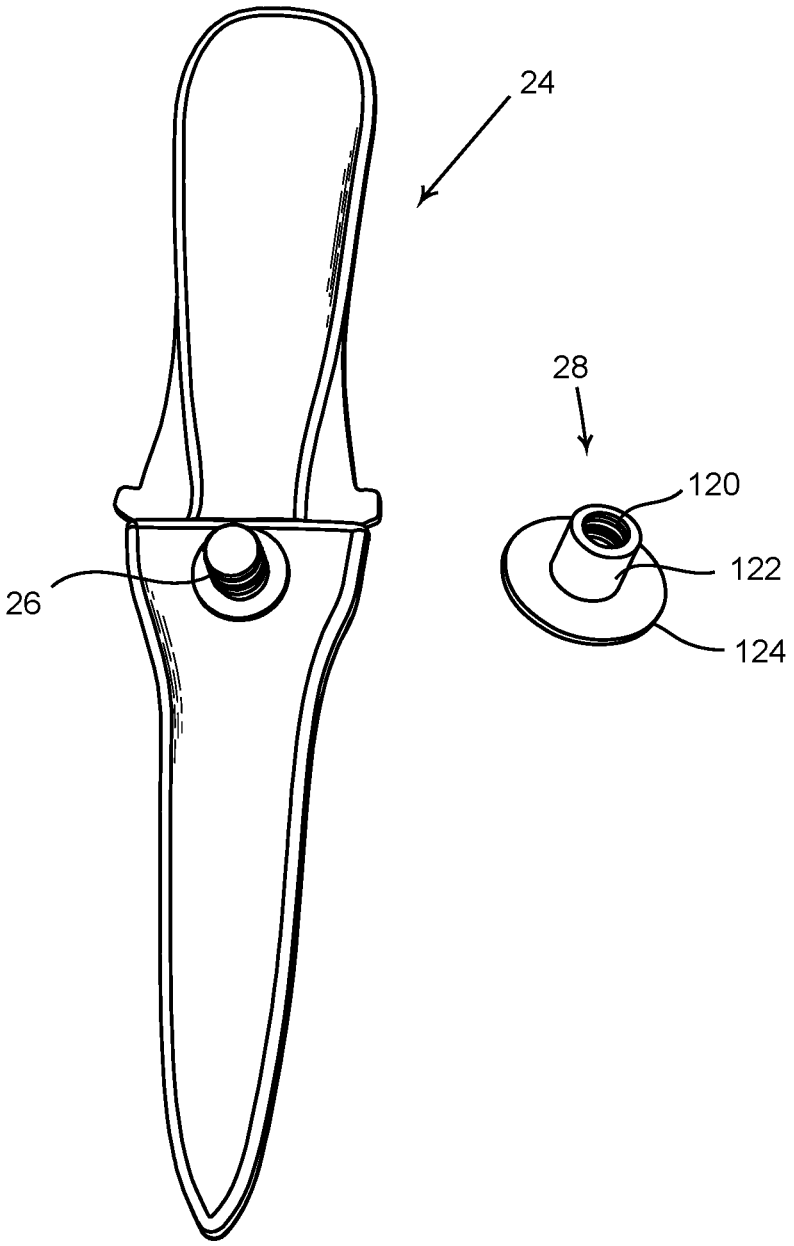
FIG. 6 illustrates an embodiment of a knife with a back screw fastener.

FIG. 6 illustrates an embodiment of a knife 24 with a back screw fastener. In an embodiment, a threaded post 26 extends from the knife 24. A back screw 28 includes a cylinder 122 with internal threads 120 that extends from a washer 124, which will be secured to the belt 14 as described earlier (See FIGS. 1-2 and the accompanying specification).

Figure 7:
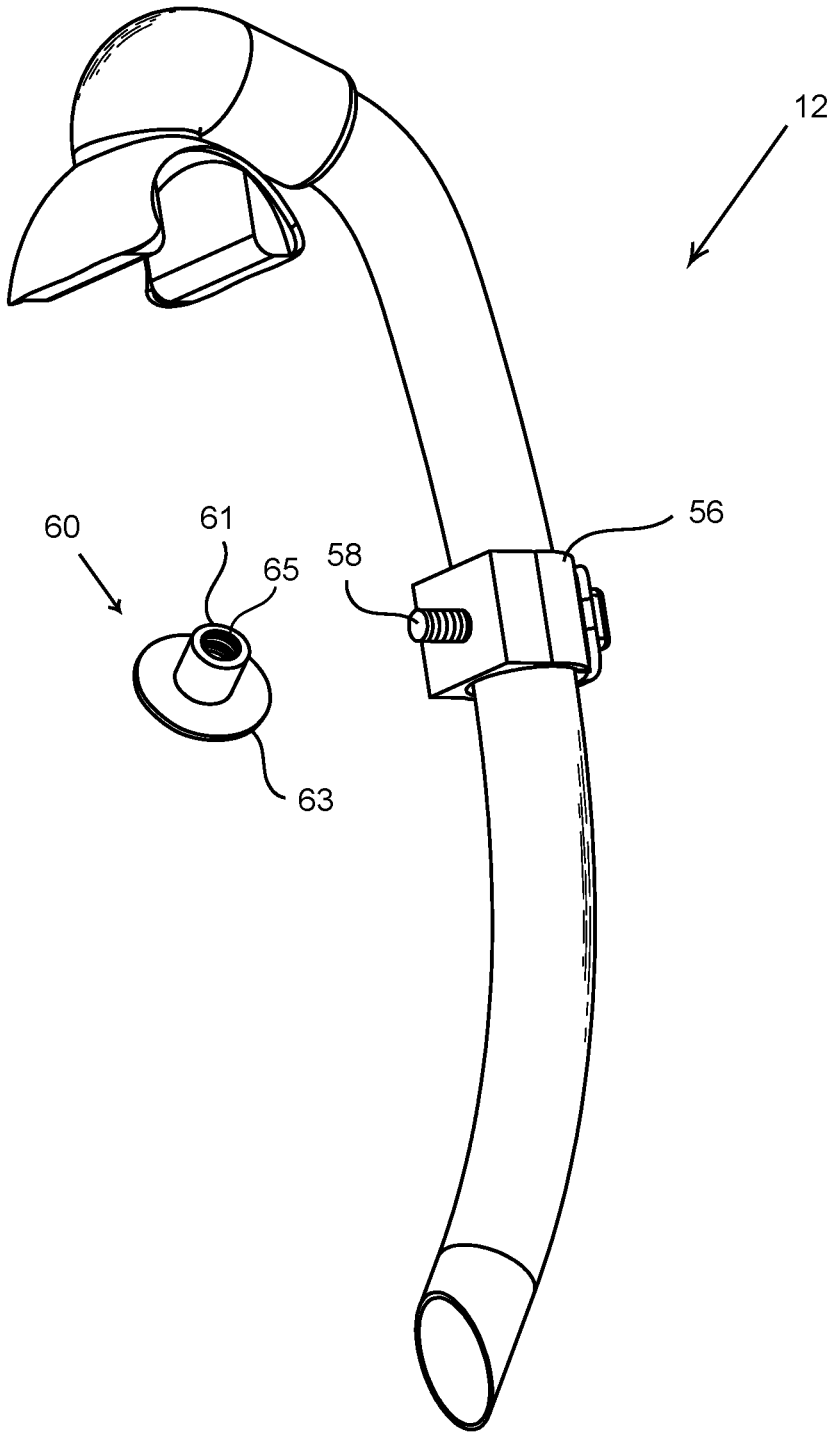
FIG. 7 illustrates an embodiment of a snorkel with a back screw fastener.

FIG. 7 illustrates an embodiment of a snorkel 12 with a back screw fastener. In an embodiment, the snorkel 12 rests in a holder 56 with a threaded post 58 that extends from a member 56. The back screw 60 includes a cylinder 61 with internal threads 65 that extends from a washer 63, which will be secured to the belt 14 as described earlier (See FIGS. 1-2 and the accompanying specification).

Figure 8A:
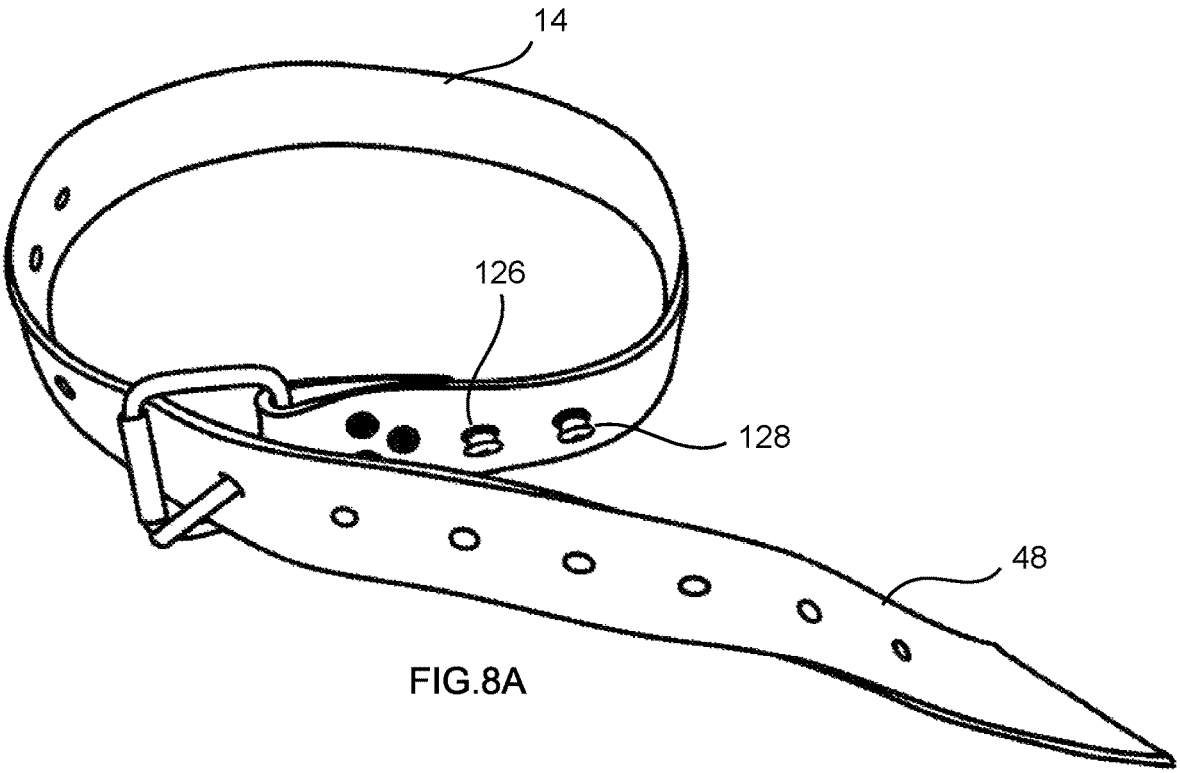
FIG. 8A illustrates an embodiment of a free diving weight belt with a knob-back screw fastener to secure the excess end of the belt.

FIG. 8A illustrates an embodiment of a free diving weight belt with knob-back screw fasteners 126 or 128 (see fasteners shown in FIGS. 3A-3D and the accompanying specification) before securing the excess end 48 of the belt 14.

Figure 8B:
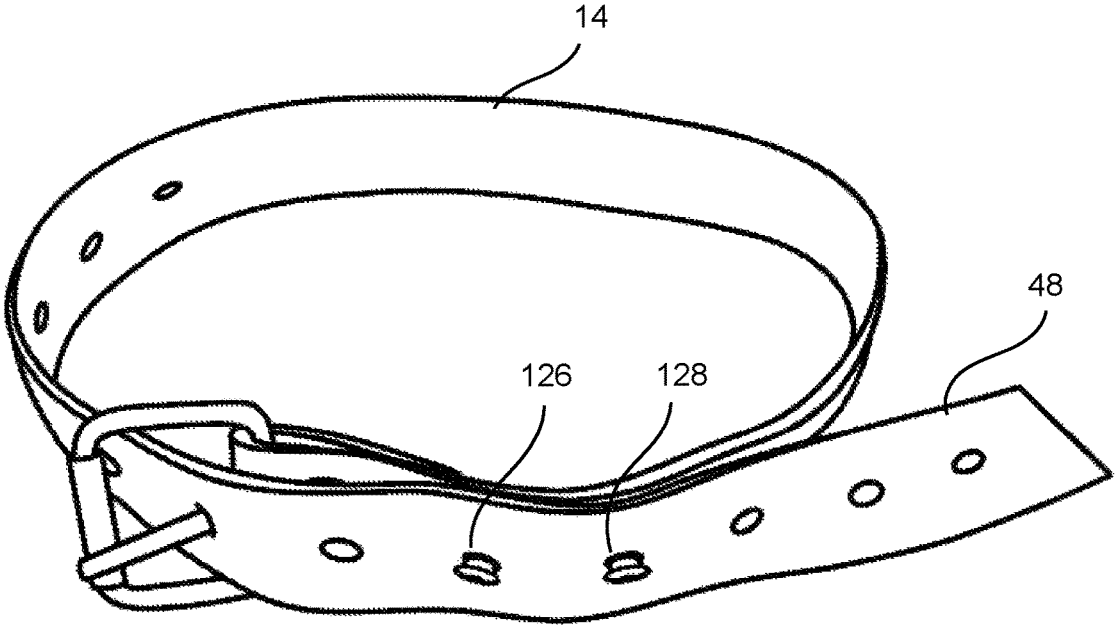
FIG. 8B illustrates the embodiment of the free diving weight belt of FIG. 8A with a knob-back screw fastener securing the excess end of the belt.

FIG. 8B illustrates the embodiment of the free diving weight belt 10 of FIG. 8A with the knob-back screw fasteners 126 and 128 now securing the excess end 48 of the belt 14.

Figure 9:
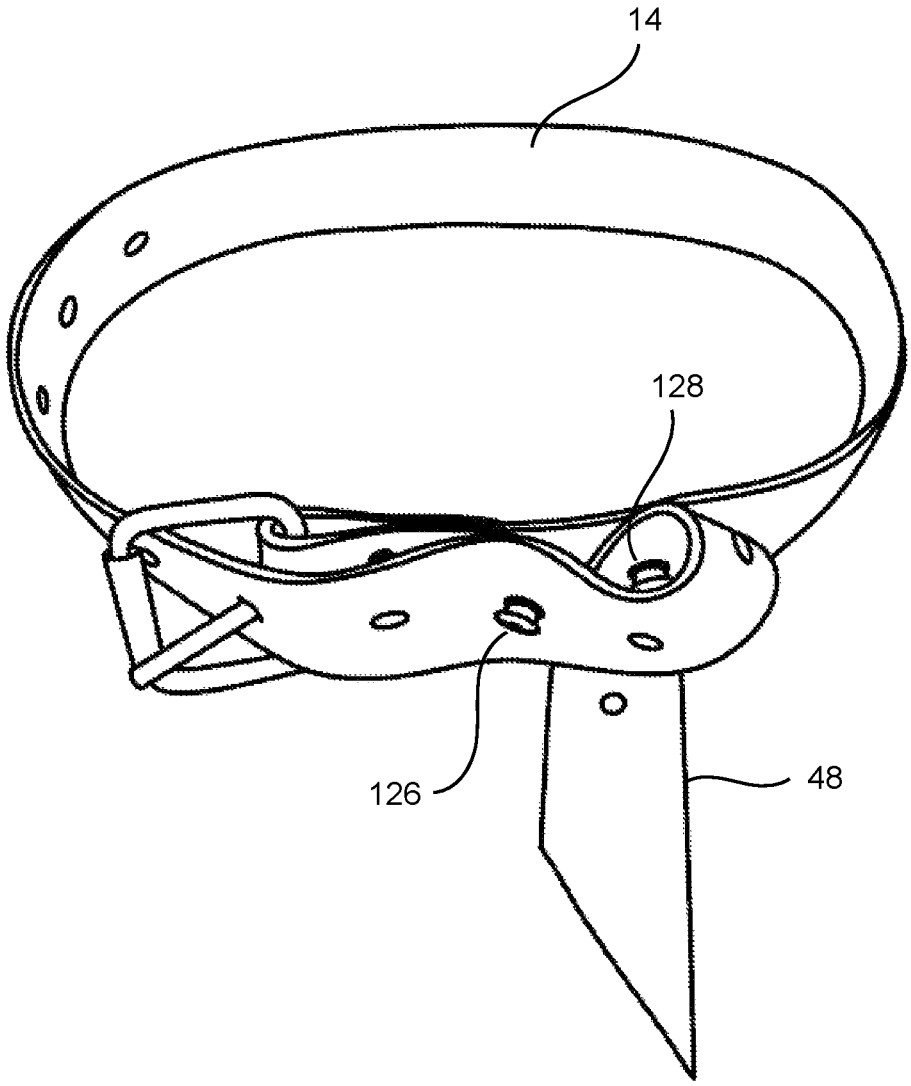
FIG. 9 illustrates an alternative embodiment of the free diving weight belt with an accessory holding loop and a knob-back screw fastener securing the excess end of the belt.

FIG. 9 is an alternative embodiment of the free diving weight belt using the knob-back screw fastener 126 and 128 along with 270-degree inside loop to form an accessory holder and secure the excess end 48 of the belt 14.

Figure 10:
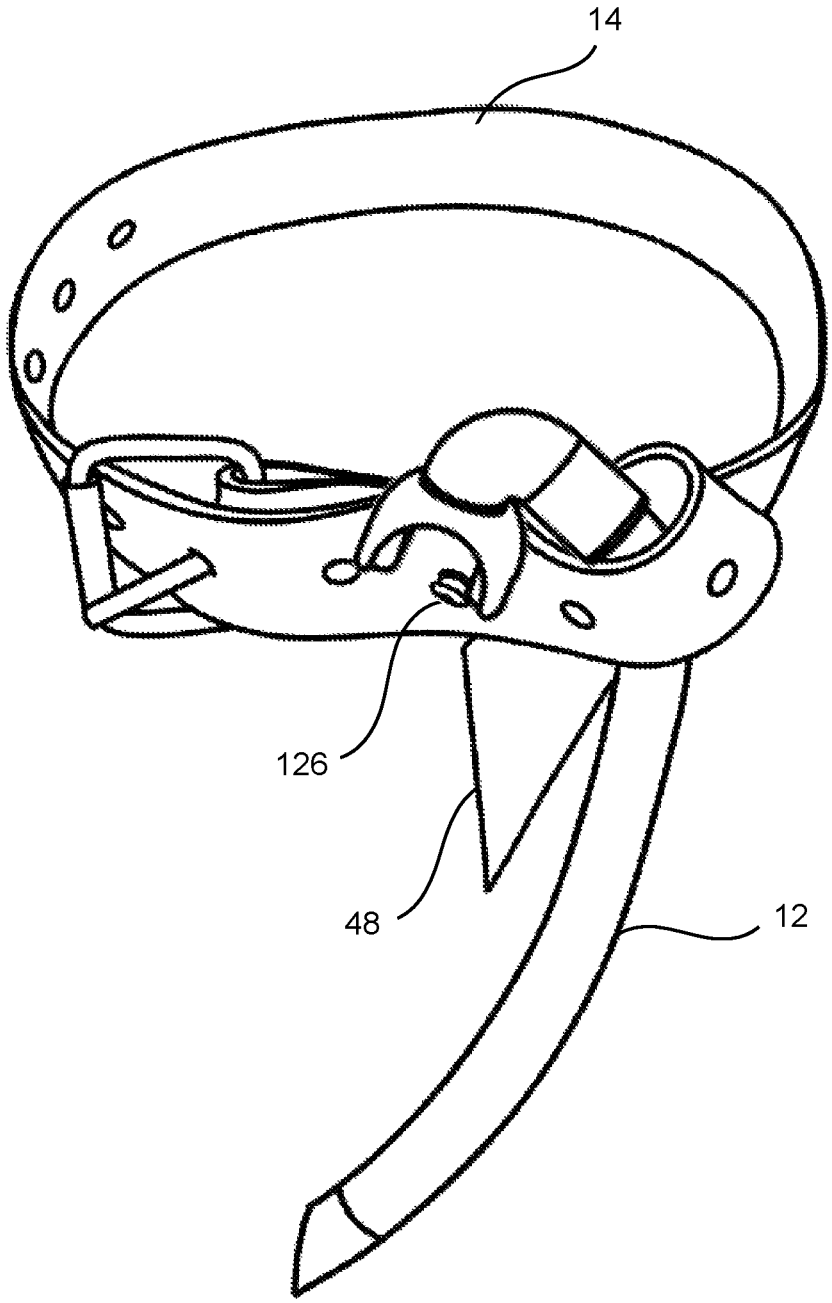
FIG. 10 illustrates the embodiment of the free diving weight belt of FIG. 9 with a snorkel held in the accessory holding loop.

FIG. 10 illustrates the embodiment of the free diving weight belt of FIG. 9 with a snorkel 12 held securely in the accessory holder.

In the above embodiments, an elastic material such as rubber or silicon is a suitable material for the belt 14, because they are durable and allows a diver to punch holes for the accessories. The weights are high density metal, e.g., lead. Stainless steel (SS) 316 is a suitable for the knife, the ring, the snorkel holder, knob-back screw fasteners and back screw fasteners and the belt buckle because SS 316 is corrosion resistant even in salt water where much free diving occurs. However, the SS 304 is less expensive and might also be used effectively for these various parts. However, choice of materials is not essential to the invention, just preferred for long life.

What is claimed:

1. A free diving weight belt for attaching accessories, comprising:

a belt with a plurality of holes to buckle the belt in a loop around a diver's waist and attach one or more accessories;

one or more accessories, wherein each accessory includes a threaded post that extends from the accessory into a hole on the front side of the belt;

a back screw with complementary threads in the hole on the back side of the belt and aligned to rotationally engage the threaded post to secure the accessory to the belt; and a knob-back screw fastener including a knob and back screw secured in a hole in the belt, wherein the knob is a spool shaped cylinder with a bottom rim and a top rim that have larger diameters than the cylindrical portion in between.

2. The free diving weight belt of claim 1, wherein the accessory is selected from the group consisting of clips, knives, snorkels, weights, ring, weight keepers, or knife holders.

3. The free diving weight belt of claim 1, wherein the accessory rotates in one direction to secure the accessory to the back screw and rotates in the opposite direction to detach the accessory.

4. The free diving weight belt of claim 1, wherein the knob includes a male threaded post aligned to rotationally engage a female threaded back screw.

5. The free diving weight belt of claim 4, wherein the back screw includes a post with threads that extends from a washer and the knob has a cylinder with internal threads that engage post threads.

6. The free diving weight belt of claim 4, wherein the knob-back screw fasteners rotate in one direction to secure the knob to the back screw to the belt and rotate in the opposite direction to detach the knob-back screw fastener.

7. The free diving weight belt of claim 1, wherein the back screw includes a male threaded post aligned to rotationally engage a female threaded knob.

8. The free diving weight belt of claim 1, wherein the knob is visible on the outside of the belt and the back screw is visible on the inside of the belt.

9. The free diving weight belt of claim 1, wherein the knob-back screw fastener(s) secure the excess end of the belt and/or define an accessory holder loop.

10. A knob-back screw fastener for a diving weight belt, comprising: a knob and back screw secured in a hole in the belt, wherein the knob includes threads aligned to rotationally engage threads of the back screw, wherein the knob is visible on the outside of the belt and the back screw is visible on the inside of the belt, wherein the knob is a spool shaped cylinder with a bottom rim and a top rim that have larger diameters than the cylindrical portion in between.

11. The knob-back screw fastener for the free diving weight belt of claim 10, wherein the knob-back screw fasteners rotate in one direction to secure the knob to the back screw to the belt and rotate in the opposite direction to detach the knob-back screw fastener.

12. The knob-back screw fastener for the free diving weight belt of claim 10, wherein the back screw includes a post with threads that extends from a washer and the knob has a cylinder with internal threads that engage post threads.

13. A free diving weight belt, comprising:

a belt with a plurality of holes to buckle the belt in a loop around a diver's waist; and a knob-back screw fastener including a knob and back screw secured in a hole in the belt, wherein the back screw includes complementary threads in the hole on the back side of the belt and aligned to rotationally engage the knob, and wherein the knob is a spool shaped cylinder with a bottom rim and a top rim that have larger diameters than the cylindrical portion in between and wherein the knob-back screw fastener secures the excess end of the belt.

* * * * *